US011536126B2

(12) United States Patent
Cobb

(10) Patent No.: US 11,536,126 B2
(45) Date of Patent: Dec. 27, 2022

(54) DOWNHOLE GAS-LIQUID SEPARATOR

(71) Applicant: Delwin E. Cobb, Houston, TX (US)

(72) Inventor: Delwin E. Cobb, Houston, TX (US)

( * ) Notice: Subject to any disclaimer, the term of this patent is extended or adjusted under 35 U.S.C. 154(b) by 162 days.

(21) Appl. No.: 17/174,059

(22) Filed: Feb. 11, 2021

(65) Prior Publication Data

US 2022/0251937 A1 Aug. 11, 2022

(51) Int. Cl.

| | |
|---|---|
| ***E21B 43/38*** | (2006.01) |
| *E21B 43/34* | (2006.01) |
| *E21B 43/36* | (2006.01) |
| *E21B 4/04* | (2006.01) |
| *E21B 43/12* | (2006.01) |

(52) U.S. Cl.
CPC ..... *E21B 43/38* (2013.01); *E21B 43/121* (2013.01)

(58) Field of Classification Search
None
See application file for complete search history.

(56) References Cited

U.S. PATENT DOCUMENTS

| | | | | |
|---|---|---|---|---|
| 3,128,719 | A * | 4/1964 | Schmit | E21B 43/38 166/105.5 |
| 5,810,081 | A * | 9/1998 | Cobb | E21B 43/38 166/105.3 |
| 6,382,317 | B1 * | 5/2002 | Cobb | E21B 43/38 96/216 |
| 6,723,158 | B2 * | 4/2004 | Brown | B01D 19/0052 96/216 |
| 2014/0158343 | A1 * | 6/2014 | Cobb | E21B 43/38 166/105.5 |

* cited by examiner

*Primary Examiner* — Matthew Troutman
*Assistant Examiner* — Douglas S Wood
(74) *Attorney, Agent, or Firm* — Patrick K. Steele

(57) ABSTRACT

A downhole gas-liquid separator (10) separates a gas from liquid in a well, with the liquid being pumped to the surface. The separator includes an outer tubular housing (12) and an inner flow tube (41) for passing the liquid phase to the surface after separation. In one embodiment, a spiral gas separator (32) imparts a helical flow to assist in separation of the gas from the well fluids. Gas from the separation chamber flows upwardly through a gas riser (25) to a downcomer (28), and then downwardly through the downcomer (28) to one or more gas vents (16) in the outer tubular housing (12). The gas riser and downcomer act as a liquid trap to exclude liquids in the annulus surrounding the tool to enter through the gas vents (16).

12 Claims, 4 Drawing Sheets

DOWNHOLE GAS-LIQUID SEPARATOR

BACKGROUND

Field of the Invention

The present invention relates to a downhole gas-liquid separator of a type used in oil and gas wells to remove gas from liquids such as water and oil. Gas-liquid separators are often used for removing gas from full well stream production before the liquid phase enters a reciprocating beam rod pump. In one embodiment, the invention relates to a combined gas-liquid separator and desander for removing both gas and solid particles from the well fluids before entering the pump.

Background of the Related Art

Various types of gas-liquid separators have been devised to reduce or eliminate gas from full well stream production before entering a downhole pump which pumps the liquid phase to the surface. Some oil and gas wells are produced using a reciprocating beam or sucker rod pump, which has a lift cycle followed by a plunger return cycle so that liquid phase is intermittently pumped to the surface during the lift cycle.

Many wells contain both gas and sand or other solid particles, and the gas and sand are preferably reduced or eliminated so that they do not enter the intake to the pump, thereby prolonging the life and improving the efficiency of the pump.

A gas separator for an ESP pump is disclosed in U.S. Pat. No. 7,673,684. U.S. Pat. Nos. Re 35,454, 5,810,081, 6,382,317, and 7,673,684 disclose relevant downhole separator technology. Additional downhole gas-liquid separators are disclosed in U.S. Pat. Nos. 7,909,092, 8,051,907 and 9,045,979, all owned by the applicant filing this application. That latter includes a vortex generator or spiraling vane to swirl and spin the full well stream to assist in separator of the gas phase from the liquid phase.

BRIEF SUMMARY

In one embodiment, the downhole separator supported on a tubular in a borehole separates a gas phase from a liquid phase which is then produced to the surface. The downhole gas-liquid separator includes an outer tubular housing having openings therein to receive full well stream production from an annulus disposed radially exterior of the outer tubular housing. An inner flow tube secured to the tubular and having an open lower end passes upward flow of produced liquid after separation of the gas from the liquid phase. In one embodiment, a vortex generator disposed radially between the inner flow tube and the outer tubular housing imparts a helical or spiraling flow to promote separation of the less dense gas from the more dense liquids. The gas phase is then vented from a separation chamber through a riser and a downcomer fluidically connected to the gas riser.

One embodiment of the downhole gas-liquid separator of the present invention is supportable by a tubular in an earthen well drilled into the earth's crust, the downhole gas-liquid separator for receiving full well stream from a subsurface geologic formation and separating a gas phase from a liquid phase, the downhole gas-liquid separator comprising an outer tubular housing having one or more intake openings therein to receive full well stream production from an annulus disposed radially exterior of the outer tubular housing, the outer tubular housing further including a gas vent opening axially above the intake openings, the embodiment of the downhole gas-liquid separator further including an inner flow tube having a bore and a liquid drain opening through a wall of the inner flow tube and through which a liquid phase separated from the gas phase enters the bore of the inner flow tube after the liquid phase is separated from the gas phase, the liquid drain opening being axially below the intake openings of the outer tubular housing, the inner flow tube further including a threaded coupling at a top end of the inner flow tube for coupling the downhole gas-liquid separator to the tubular that supports the gas-liquid separator in the well. The outer tubular housing and the inner flow tube together form an annular chamber disposed radially intermediate the inner flow tube and the outer tubular housing, the annular chamber being adjacent to the intake openings in the outer tubular housing to receive full well stream from the annulus, the downhole gas-liquid separator further including an upper barrier forming a top of the annular chamber, the upper barrier having an opening to a gas riser through which the gas phase passes after being separated from the liquid phase in the annular chamber, the upper barrier being disposed axially intermediate the intake openings and the gas vent of the outer tubular housing, the downhole gas-liquid separator further including a lower barrier forming a bottom of the annular chamber, the lower barrier being below the liquid drain opening in the inner flow tube. The gas riser ascends from the opening in the upper barrier to a terminus of the gas riser that is disposed above the opening of the upper barrier and above the gas vent of the outer tubular housing. The downhole gas-liquid separator further includes a downcomer having a top end in fluid communication with the terminus of the gas riser and a lower end disposed adjacent to the gas vent to allow gas flow passing through the gas riser to enter the downcomer and to then exit the gas-liquid separator through the gas vent of the outer tubular housing to the annulus surrounding the outer tubular housing.

One embodiment of the downhole gas-liquid separator further includes a liquid drain passage having an opening at the bottom of the annular chamber and a terminus adjacent to the liquid drain opening in the inner flow tube. The liquid drain passage may include a portion that spirals about an outer circumference of the lower barrier to provide flow resistance and to thereby control or limit the rate at which the liquid phase, after being separated from the gas phase in the annular chamber, can be removed from the annular chamber by way of the liquid drain passage.

In one embodiment of the downhole gas-liquid separator, the upper barrier sealably engages the outer tubular housing to prevent gas leakage from the annular chamber and forces all of the gas phase separated from the liquid phase in the annular chamber to exit the annular chamber through the gas riser. Similarly, in one embodiment of the downhole gas-liquid separator of the present invention, the lower barrier sealably engages the outer tubular housing to prevent liquid leakage from the annular chamber and to force all liquid phase exiting the annular chamber to flow through the liquid drain passage.

In one embodiment of the downhole gas-liquid separator of the present invention, the outer tubular housing is removable to expose the annular chamber.

These and further features and advantages of the present invention will become apparent from the following detailed description, wherein reference is made to the figures in the accompanying drawings.

DETAILED DESCRIPTION

Figure 1:
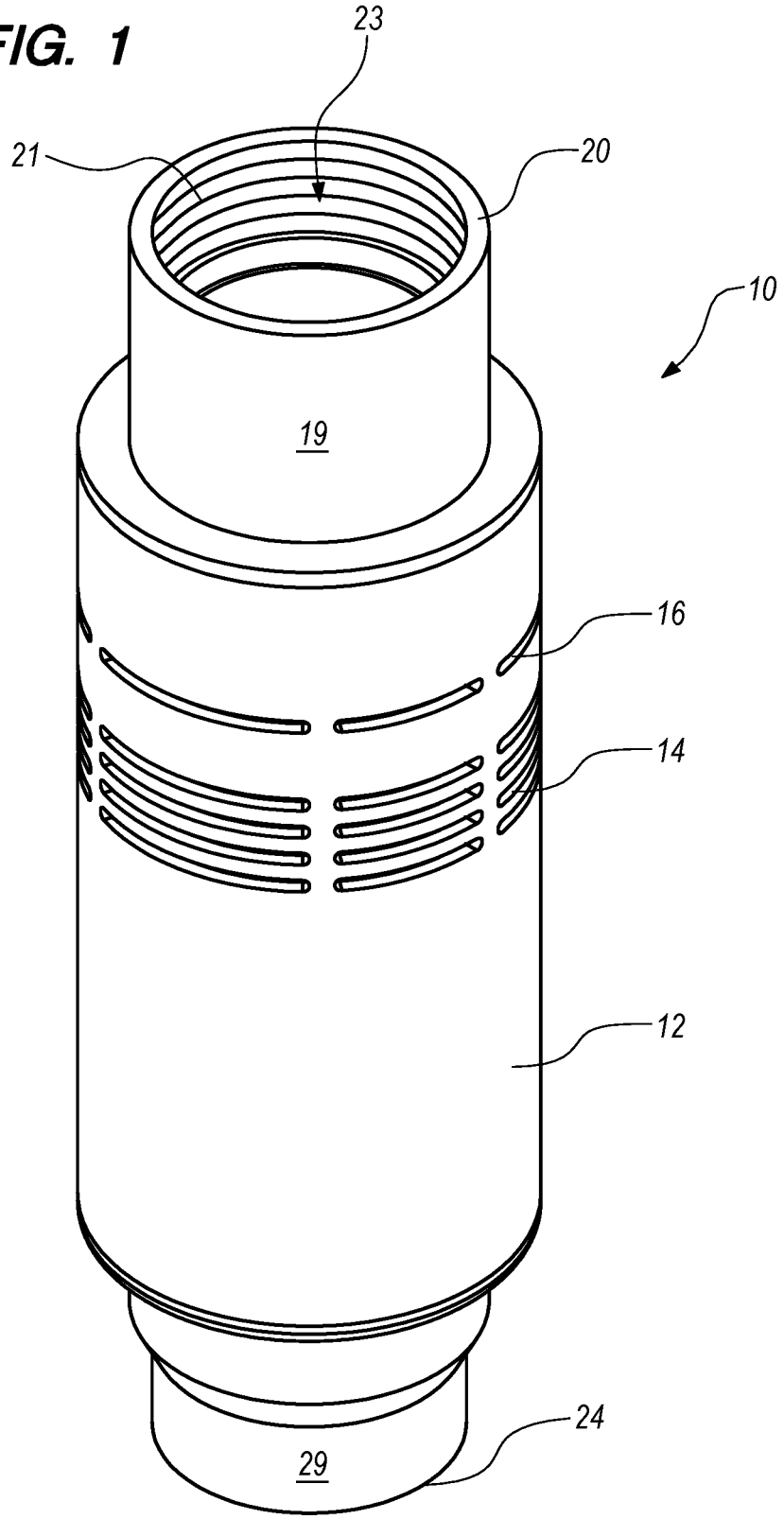
FIG. 1 is perspective view of an embodiment of a downhole gas-liquid separator 10 of the present invention.

FIG. 1 is perspective view of an embodiment of a downhole gas-liquid separator 10 of the present invention having an upper threaded connector 19 at a upper end 20, a lower threaded connector 29 (or, alternately, a blind cap) at a lower end 24, an outer tubular housing 12 with a plurality of angularly distributed and axially distributed intake ports 14 and a plurality of angularly distributed gas vents 16 above the plurality of intake ports 14. The upper threaded connector 19 has an interior thread 21 for threadedly coupling the downhole gas-liquid separator 10 to a lower threaded connector 29 at a lower end 24 of an axially adjacent gas-liquid separator 10 or to a distal end of a tubular (not shown) used to position the downhole gas-liquid separator 10 within a bore of an earthen well (not shown) and to support the gas-liquid separator 10 within the bore of the earthen well. Similarly, the lower end 24 of the downhole gas-liquid separator 10 may include a threaded connector 29 for coupling the downhole gas-liquid separator 10 to an axially adjacent gas-liquid separator 10. Some embodiments of the downhole gas-liquid separator 10 of the present invention are adapted to be connected one to others in a stack or series, as will be discussed in more detail below in connection with FIG. 3.

Figure 2:
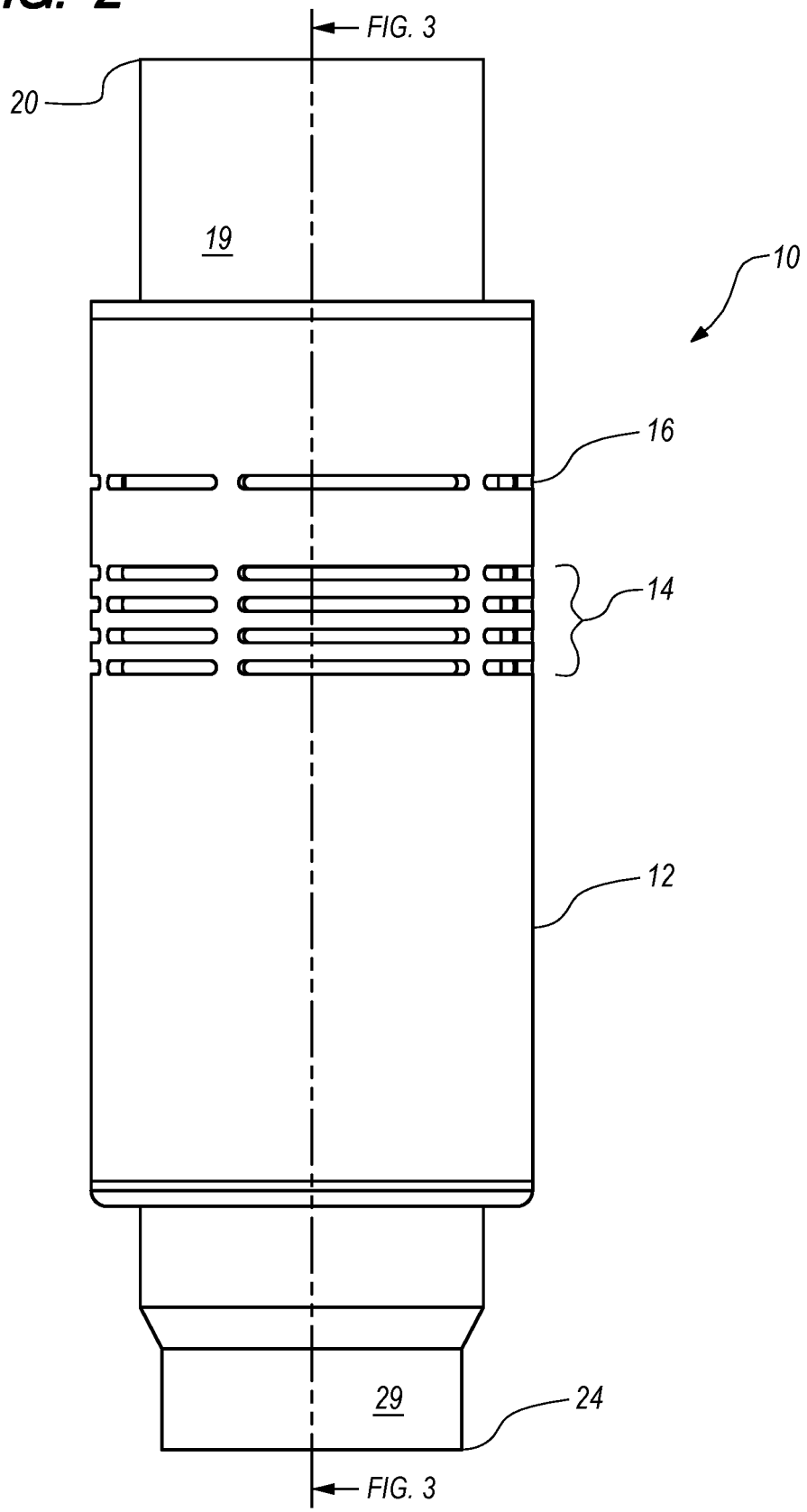
FIG. 2 is an elevation view of the gas-liquid separator of FIG. 1.

FIG. 2 is an elevation view of the downhole gas-liquid separator of FIG. 1. FIG. 2 shows the threaded connection 19 at the upper end 20 of the downhole gas-liquid separator 10, the cap or threaded connection 29 at the lower end 24 of the downhole gas-liquid separator 10, and the tubular outer housing 12 with the plurality of intake ports 14 and the plurality of gas vents 16 therein. The threaded connection 29 at the lower end 24 can be, in other embodiments, replaced by a blind cap if the downhole gas-liquid separator 10 is lowermost in a series of connected downhole gas-liquid separators. A blind cap may be used for a lowermost gas-liquid separator in a stacked or series arrangement of gas-liquid separators 10 or it may be used where only one gas-liquid separator 10 is used.

Figure 3:
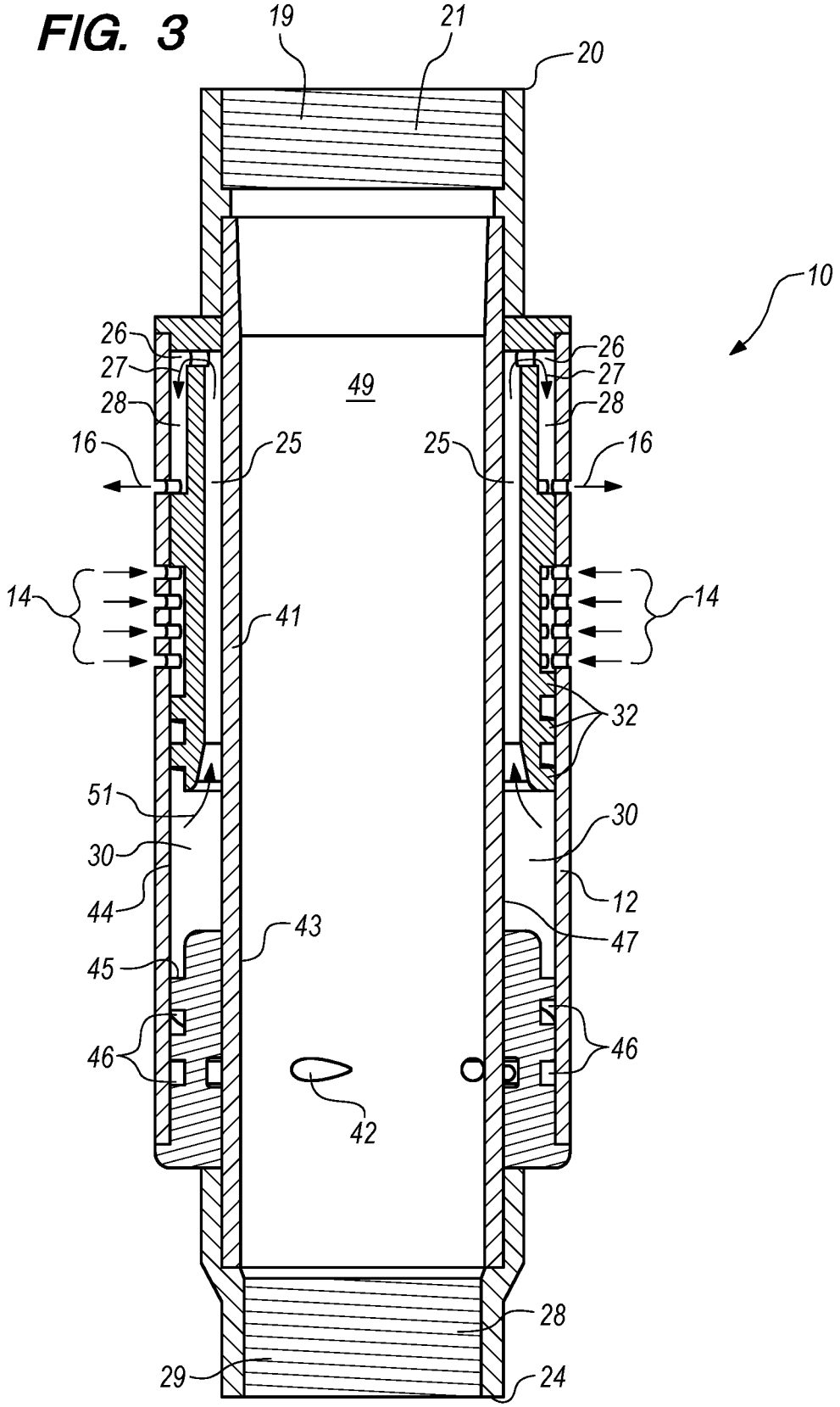
FIG. 3 is an elevation cross-sectional view of the gas-liquid separator of FIGS. 1 and 2.

FIG. 3 is an elevation cross-sectional view of the gas-liquid separator of FIGS. 1 and 2. FIG. 3 shows the upper threaded connector 19 and the thread 21 therein, the lower threaded connector 29 with a thread 28 therein, the outer tubular housing 12 with the plurality of intake ports 14 and the plurality of gas vents 16 therein, and the inner flow tube 41 having a wall 43 and a liquid drain opening 42 through the wall 43 of the inner flow tube 41. An annular chamber 30 is formed radially intermediate the inner flow tube 41 and the outer tubular housing 12. Full well stream (not shown), or a mixture of a gas phase and a liquid phase, enters the downhole gas-liquid separator 10 through the intake ports 14 and flows downwardly and then across a spiraling vane 32 that induces the full well stream to vortex, swirl or spin about as it enters the annular chamber 30. The spiraling vane 32 promotes better separation of the full well stream into the gas phase and the liquid phase in the annular chamber 30 because the more dense liquid phase is spun radially outwardly against an interior wall 44 of the outer tubular housing 12 while the less dense gas phase is displaced radially inwardly towards the interior wall 47 of the outer tubular housing 12. The separated liquid phase flows downwardly towards the lower barrier 45 and flows into the liquid drain passage 46 and ultimately is discharged through the liquid drain opening 42 through the wall 43 of the inner flow tube 41. The bore 49 of the inner flow tube 41 allows liquid entering the downhole gas-liquid separator 10 through the lower threaded connector 29 (from, for example, an axially adjacent lower downhole gas-liquid separator that may be connected in series to the downhole gas-liquid separator 10) and liquid phase that enters the bore 49 through the liquid drain opening 42 through the wall 43 of the inner flow tube 41 to commingle and to be produced upwardly through the upper threaded connector 19.

The separated gas phase exits the annular chamber 30 through the opening 51 into the gas riser 25. The gas riser extends upwardly and away from the annular chamber 30 at which it originates and terminates at a terminus 26. A downcomer 28 is in fluid communication with the gas riser 25 and the gas phase exiting the annular chamber 30 through the opening 51 and the gas riser 25 then flows downwardly through the downcomer 28 to exit the downhole gas-liquid separator 10 at the gas vents 16 of the outer tubular housing 12. The downcomer 28 is not as long as the gas riser 25, and the gas vents 16 of the outer tubular housing 12 are above the elevation of the opening 51 at which the gas phase enters the gas riser 25. This causes a gas trap that prevents or at least impairs the unwanted backflow of liquid from the annulus surrounding the outer tubular housing 12 from entering the downcomer 28, flowing upwardly to the terminus 26 and then downwardly through the gas riser 25 to the annular chamber 30. This promotes the sustained flow of the gas phase as indicated by the arrow 27.

Figure 4:
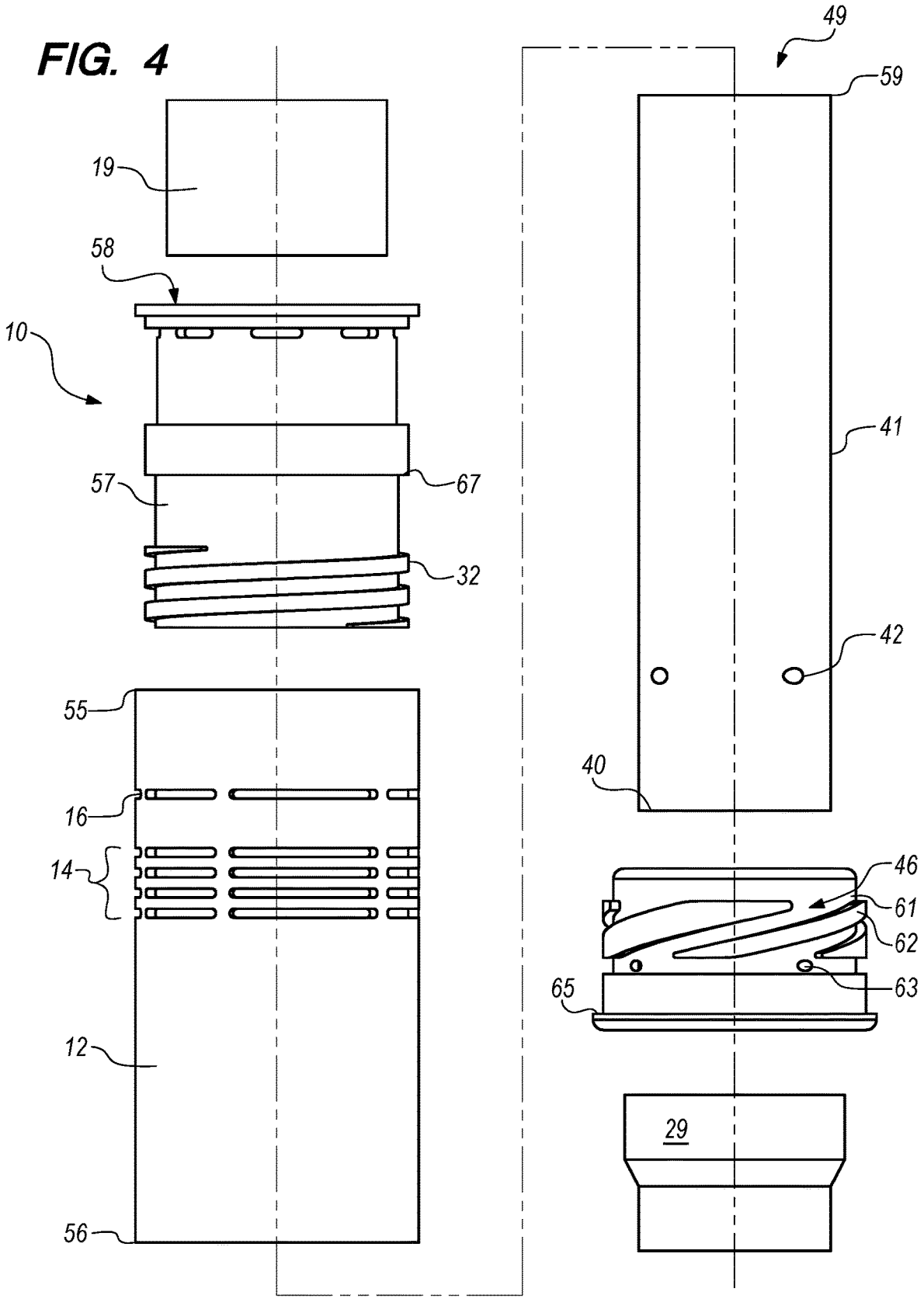
FIG. 4 is an exploded view of an embodiment of the gas-liquid separator of the present invention comprising assembled components.

FIG. 4 is an exploded view of an embodiment of the gas-liquid separator 10 of the present invention comprising assembled components. The outer tubular housing 12 is the same, and includes the plurality of intake ports 14 and the plurality of gas vents 16, a top end 55, and a bottom end 56. A vortex assembly 57 that includes a spiraling vane 32 receives the inner flow tube 41 within a bore 58 of the vortex assembly 57, and may be secured thereon by, for example, set screws (not shown) or adhesives. The upper threaded connector 19 is then coupled to an upper end 59 of the inner flow tube 41, and may also be secured thereon by set screws (not shown) or adhesives. The drain assembly 61 that includes a spiraling liquid drain passage 46 formed by a spiraling vane 62 about the drain assembly 61 provides flow resistance to the liquid phase that flows through the drain passage 46 to the liquid drain opening 42 through the wall 43 (not shown in FIG. 4—see FIG. 3) that allows the liquid phase, after separation from the gas phase, to flow into the bore 49 of the inner flow tube 41 for delivery to a pump suction. The lower connector 29 is then coupled to the distal end 40 of the inner flow tube 41 using, for example, set screws (not shown) or adhesives.

The drain assembly 61 provides a shoulder 65 to engage and abut a distal end 56 of the outer tubular housing 41 upon assembly of the downhole gas-liquid separator 10 and the vortex assembly 57 provides an opposed shoulder 67 to engage and abut a proximal end 55 of the outer tubular housing 41 upon assembly of the downhole gas-liquid separator 10.

While FIG. 4 illustrates an embodiment of the downhole gas-liquid separator 10 that can be assembled from components, other embodiments may be cast and other embodiments may be made using three-dimensional printers. The drawings appended hereto are not intended to cover all embodiments of the downhole gas-liquid separator 10 of the present invention, and the invention is limited only by the appended claims. As usual, the environment in which the tool is to be used may dictate either the materials used to make the downhole gas-liquid separator 10 or the assembly methods, or both.

Although specific embodiments of the invention have been described herein in some detail, this has been done solely for the purposes of explaining the various aspects of the invention, and is not intended to limit the scope of the invention as defined in the claims which follow. Those skilled in the art will understand that the embodiment shown and described is exemplary, and various other substitutions, alterations and modifications, including but not limited to those design alternatives specifically discussed herein, may be made in the practice of the invention without departing from its scope.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, components and/or groups, but do not preclude the presence or addition of one or more other features, integers, steps, operations, elements, components, and/or groups thereof. The terms "preferably," "preferred," "prefer," "optionally," "may," and similar terms are used to indicate that an item, condition or step being referred to is an optional (not required) feature of the invention.

The corresponding structures, materials, acts, and equivalents of all means or steps plus function elements in the claims below are intended to include any structure, material, or act for performing the function in combination with other claimed elements as specifically claimed. The description of the present invention has been presented for purposes of illustration and description, but it is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

What is claimed is:

1. A downhole gas-liquid separator supportable in a well by a tubular in an earthen well drilled into the earth's crust, the downhole gas-liquid separator for separating a gas phase from a liquid phase of a full well stream entering the well from subsurface geologic formations penetrated by the well, the downhole gas-liquid separator comprising:

an outer tubular housing having intake openings therein to receive full well stream production from an annulus disposed radially exterior of the outer tubular housing, the outer tubular housing further including a gas vent opening axially above the intake openings;

an inner flow tube having a bore and a liquid drain opening through a wall of the inner flow tube and through which a liquid phase separated from the gas phase enters the bore of the inner flow tube after the liquid phase is separated from the gas phase, the liquid drain opening being below the intake openings of the outer tubular housing, the inner flow tube further including a threaded coupling at a top end of the inner flow tube for coupling the downhole gas-liquid separator to the tubular that supports the gas-liquid separator in the well;

an annular chamber disposed radially intermediate the inner flow tube and the outer tubular housing, the annular chamber being adjacent to the intake openings in the outer tubular housing to receive full well stream from the annulus;

an upper barrier forming a top of the annular chamber, the upper barrier having an opening to a gas riser through which the gas phase separated from the liquid phase in the annular chamber passes, the upper barrier being disposed axially intermediate the intake openings and the gas vent of the outer tubular housing;

a lower barrier forming a bottom of the annular chamber, the lower barrier being below the liquid drain opening;

a terminus of the gas riser disposed above the opening of the upper barrier and above the gas vent of the outer tubular housing; and a downcomer having a top end in fluid communication with the terminus of the gas riser and a lower end disposed adjacent to the gas vent to allow gas flow passing through the gas riser to enter the downcomer and to then exit the gas-liquid separator through the gas vent to the annulus.

2. The gas-liquid separator of claim 1, further comprising a liquid drain passage having an opening at the bottom of the chamber and a terminus adjacent to the liquid drain opening in the inner tubular.

3. The gas-liquid separator of claim 2, wherein the liquid drain passage spirals about an outer periphery of the lower barrier to the terminus to provide flow resistance.

4. The gas-liquid separator of claim 1, wherein the upper barrier sealably engages the outer tubular housing to prevent gas leakage from the chamber other than through the gas riser.

5. The gas-liquid separator of claim 4, wherein the lower barrier sealably engages the outer tubular housing to prevent liquid leakage from the chamber other than through the liquid drain passage.

6. The gas-liquid separator of claim 1, wherein the outer tubular housing is removable to expose the chamber.

7. A downhole gas-liquid separator supportable in a well by a tubular in an earthen well drilled into the earth's crust, the downhole gas-liquid separator for separating a gas phase from a liquid phase of a gas and liquid mixture entering the well from subsurface geologic formations penetrated by the well, the downhole gas-liquid separator comprising:

an outer tubular housing having intake openings therein to receive a stream including a gas phase and a liquid phase and a gas vent opening axially above the intake openings;

an inner flow tube having a bore and a liquid drain opening through which a liquid phase separated from the gas phase enters the bore of the inner flow tube, the liquid drain opening being below the intake openings of the outer tubular housing, the inner flow tube further including a threaded coupling at a top end of the inner flow tube;

an annular chamber disposed radially intermediate the inner flow tube and the outer tubular housing, the annular chamber being adjacent to the intake openings in the outer tubular housing;

an upper barrier forming a top of the annular chamber, the upper barrier having an opening to a gas riser, the upper barrier being disposed axially intermediate the intake openings and the gas vent;

a lower barrier forming a bottom of the annular chamber, the lower barrier being below the liquid drain opening;

a terminus of the gas riser disposed above the opening of the upper barrier and above the gas vent; and a downcomer having a top end in fluid communication with the terminus of the gas riser and a lower end disposed adjacent to the gas vent.

8. The gas-liquid separator of claim 7, further comprising a liquid drain passage having an opening at the bottom of the annular chamber and a terminus adjacent to the liquid drain opening in the inner tubular.

9. The gas-liquid separator of claim 8, wherein the liquid drain passage spirals about an outer periphery of the lower barrier to the terminus.

10. The gas-liquid separator of claim 7, wherein the upper barrier sealably engages the outer tubular housing to prevent gas leakage from the chamber other than through the gas riser.

11. The gas-liquid separator of claim 10, wherein the lower barrier sealably engages the outer tubular housing to prevent liquid leakage from the chamber other than through the liquid drain passage.

12. The gas-liquid separator of claim 7, wherein the outer tubular housing is removable to expose the annular chamber.

* * * * *